US009233784B2

(12) United States Patent
Jacober et al.

(10) Patent No.: US 9,233,784 B2
(45) Date of Patent: Jan. 12, 2016

(54) VENTED METALLIC CONTAINER END CLOSURE

(71) Applicant: Ball Corporation, Broomfield, CO (US)

(72) Inventors: Mark A. Jacober, Arvada, CO (US); Howard C. Chasteen, Westminster, CO (US)

(73) Assignee: Ball Corporation, Broomfield, CO (US)

( * ) Notice: Subject to any disclaimer, the term of this patent is extended or adjusted under 35 U.S.C. 154(b) by 618 days.

(21) Appl. No.: 13/667,928

(22) Filed: Nov. 2, 2012

(65) Prior Publication Data

US 2013/0118133 A1 May 16, 2013

Related U.S. Application Data

(60) Provisional application No. 61/555,657, filed on Nov. 4, 2011.

(51) Int. Cl.

| | |
|---|---|
| ***B65D 17/34*** | (2006.01) |
| ***B65D 35/44*** | (2006.01) |
| ***B65D 39/00*** | (2006.01) |
| ***B65D 41/00*** | (2006.01) |
| ***B65D 51/00*** | (2006.01) |

(Continued)

(52) U.S. Cl.

CPC ..... *B65D 51/00* (2013.01); *B65D 17/165* (2013.01); *B67B 7/00* (2013.01); *B65D 2517/0014* (2013.01); *B65D 2517/0094* (2013.01)

(58) Field of Classification Search

CPC ..... B65D 17/165; B65D 2517/0014; B65D 2517/0092; B65D 17/24; B65D 2517/0079; B65D 51/00; B65D 2205/00; B65D 17/16; B65D 17/161; B65D 17/163; B21D 51/38; B21D 51/383

USPC ..... 53/492, 381.1; 220/269, 271, 200, 220/705–710

See application file for complete search history.

(56) References Cited

U.S. PATENT DOCUMENTS

| | | | |
|---|---|---|---|
| 1,847,794 | A | 3/1932 | Takeda |
| 2,160,429 | A | 5/1939 | Bukolt |

(Continued)

FOREIGN PATENT DOCUMENTS

| | | |
|---|---|---|
| CA | 2280461 | 2/2001 |
| CA | 2657391 | 1/2008 |

(Continued)

OTHER PUBLICATIONS

Official Action for Canadian Patent Application No. 2,806,879 dated Oct. 23, 2013, 2 pages.

(Continued)

*Primary Examiner* — Stephen F Gerrity
*Assistant Examiner* — Eyamindae Jallow
(74) *Attorney, Agent, or Firm* — Sheridan Ross P.C.

(57) ABSTRACT

A metallic container end closure is provided that generally comprises a dispensing opening and a vent opening. The vent opening improves pourability through the dispensing opening and provides an alternative option for consuming the contents of the container. The end closure may include features to ease opening of the vent opening, such as stiffeners and/or vent form features. Additionally, the end closure may include various safety features, such as a safety fold. In some configurations, the container end closure does not include a pull tab for opening.

11 Claims, 14 Drawing Sheets

(51) Int. Cl.
*B67B 7/00* (2006.01)
*B65D 17/00* (2006.01)

(56) References Cited

U.S. PATENT DOCUMENTS 2,272,111 A 2/1942 Dove
3,169,678 A 2/1965 Wilkinson
3,215,305 A 11/1965 Frankenberg
3,227,304 A 1/1966 Asbury
3,246,791 A 4/1966 Asbury
3,262,611 A 7/1966 Palmer
3,307,737 A 3/1967 Harvey et al.
3,326,406 A 6/1967 Brown
D208,591 S 9/1967 Bozek
3,362,569 A 1/1968 Geiger
3,370,169 A 2/1968 Bozek
3,441,169 A 4/1969 Dunn et al.
3,446,389 A 5/1969 Brown
3,499,573 A * 3/1970 Adams ..... 220/271
3,618,815 A 11/1971 Heffner
3,731,836 A 5/1973 Silver
3,741,432 A 6/1973 Werth et al.
3,744,667 A 7/1973 Fraze et al.
3,762,597 A 10/1973 Kaminski et al.
3,765,208 A 10/1973 Cozert
3,779,417 A 12/1973 Klein
3,794,206 A 2/1974 De Line et al.
3,826,401 A 7/1974 Zundel
3,833,144 A 9/1974 Bollmann et al.
3,836,038 A 9/1974 Cudzik
3,856,184 A 12/1974 Luviano
3,877,604 A 4/1975 Brown
3,881,630 A 5/1975 Lovell et al.
3,908,856 A 9/1975 Perry
D238,150 S 12/1975 Cudzik
D238,659 S 2/1976 Wallace
D239,255 S 3/1976 Brincks et al.
D239,256 S 3/1976 Brincks et al.
RE28,910 E 7/1976 Dalli et al.
3,970,212 A 7/1976 Brown
3,982,657 A 9/1976 Keller et al.
4,024,981 A 5/1977 Brown
4,030,631 A 6/1977 Brown
4,032,034 A 6/1977 Willis
4,039,100 A 8/1977 Wells
4,051,976 A 10/1977 Perry
4,054,228 A 10/1977 Balocca et al.
4,061,243 A 12/1977 Khoury
4,062,471 A 12/1977 Perry et al.
4,073,403 A 2/1978 Orange
4,084,721 A 4/1978 Perry
4,105,133 A 8/1978 La Barge et al.
4,128,186 A 12/1978 Gane
4,146,149 A 3/1979 Beveridge
4,148,410 A 4/1979 Brown
4,184,607 A 1/1980 Potts
4,196,823 A 4/1980 Madden et al.
D255,424 S 6/1980 Bathurst
D255,425 S 6/1980 Bathurst
4,205,760 A 6/1980 Hasegawa
RE30,349 E 7/1980 Silver
4,210,257 A 7/1980 Radtke
4,213,538 A 7/1980 Boardman
4,244,489 A 1/1981 Klein
4,244,490 A 1/1981 Klein
4,252,247 A 2/1981 Asbury
4,257,529 A 3/1981 Saunders
4,267,938 A * 5/1981 Debenham et al. ..... 220/268
D259,403 S 6/1981 Frazier
4,276,993 A 7/1981 Hasegawa
4,280,427 A 7/1981 Potts
4,289,251 A 9/1981 Maliszewski
4,305,523 A 12/1981 Dalli et al.
4,318,494 A 3/1982 Heyn
4,320,850 A 3/1982 Drolen, Jr.
4,361,251 A 11/1982 Langseder et al.
D267,633 S 1/1983 Christian
4,397,403 A 8/1983 Guimarin
4,402,421 A 9/1983 Ruemer, Jr.
4,416,389 A 11/1983 Wilkinson et al.
4,438,865 A 3/1984 Scattaregia
4,448,325 A 5/1984 Edwards et al.
4,465,204 A * 8/1984 Kaminski et al. ..... 220/269
4,576,306 A 3/1986 Kelsey et al.
4,901,880 A 2/1990 Tatham et al.
4,930,658 A 6/1990 McEldowney
4,994,009 A 2/1991 McEldowney
5,007,554 A 4/1991 Hannon et al.
5,011,037 A 4/1991 Moen et al.
5,064,087 A 11/1991 Koch
5,065,882 A 11/1991 Sugiyama
5,129,541 A 7/1992 Voigt et al.
5,131,555 A 7/1992 DeMars et al.
5,219,257 A 6/1993 Kock
5,224,618 A 7/1993 Garbiso
5,248,053 A 9/1993 Lundgren
5,285,919 A 2/1994 Recchia
5,307,947 A 5/1994 Moen et al.
D353,769 S 12/1994 Miller
5,375,729 A 12/1994 Schubert
5,397,014 A 3/1995 Aydt
5,405,039 A 4/1995 Komura
5,456,378 A 10/1995 DeMars
D365,274 S 12/1995 Cook
5,494,184 A 2/1996 Noguchi et al.
5,555,992 A 9/1996 Sedgeley
5,653,355 A * 8/1997 Tominaga et al. ..... 220/269
5,655,678 A 8/1997 Kobayashi
D385,192 S 10/1997 Hurst et al.
5,683,006 A 11/1997 Cook
5,692,636 A 12/1997 Schubert
5,695,085 A 12/1997 Hadener
5,711,448 A 1/1998 Clarke, III
5,713,481 A 2/1998 Jordan
5,715,964 A 2/1998 Turner et al.
5,819,973 A 10/1998 Traub, Sr. et al.
D402,887 S 12/1998 Hurst
5,860,553 A 1/1999 Schubert
5,911,331 A 6/1999 Boller
D415,026 S 10/1999 Turner et al.
5,964,366 A 10/1999 Hurst et al.
5,975,327 A 11/1999 Funk
5,979,697 A 11/1999 Kim
6,024,239 A 2/2000 Turner et al.
D424,438 S 5/2000 Turner et al.
6,059,137 A 5/2000 Westwood et al.
6,079,583 A 6/2000 Chasteen
6,131,763 A 10/2000 Stanish et al.
6,145,866 A 11/2000 Peter
D434,983 S 12/2000 Hurst
6,161,717 A 12/2000 Forrest et al.
6,202,880 B1 3/2001 Strube et al.
6,330,954 B1 12/2001 Turner et al.
6,354,453 B1 3/2002 Chasteen
6,375,029 B2 4/2002 Anthony et al.
6,499,329 B1 12/2002 Enoki et al.
6,715,629 B2 4/2004 Hartman et al.
6,761,281 B2 7/2004 Hartman
6,837,093 B2 1/2005 Yamasaki
7,000,797 B2 2/2006 Forrest et al.
7,096,759 B2 8/2006 Kirko
7,100,789 B2 9/2006 Nguyen et al.
D535,561 S 1/2007 Smith et al.
D559,680 S 1/2008 Jacober et al.
7,506,779 B2 3/2009 Jentzsch et al.
7,513,383 B2 4/2009 Hwang
7,516,869 B1 * 4/2009 Hajianpour ..... 220/707
7,748,557 B2 7/2010 Robinson
7,891,519 B2 * 2/2011 Matsukawa et al. ..... 220/272
7,918,359 B2 4/2011 Paris et al.
7,975,884 B2 7/2011 Mathabel et al.
D653,944 S 2/2012 Seki et al.
8,136,689 B2 3/2012 Ulstein et al.
8,152,016 B2 4/2012 Berndt et al.

(56) References Cited

U.S. PATENT DOCUMENTS

| | | | | |
|---|---|---|---|---|
| 8,245,866 | B2 | 8/2012 | Gibson et al. | |
| 8,336,726 | B2 | 12/2012 | Ramsey et al. | |
| 8,397,935 | B2 | 3/2013 | Emanuele, III et al. | |
| D691,039 | S | 10/2013 | Jacober et al. | |
| 8,627,979 | B2 | 1/2014 | Thibaut et al. | |
| 8,646,643 | B2 | 2/2014 | Forrest et al. | |
| D727,725 | S * | 4/2015 | Jacober et al. | D9/438 |
| 9,033,174 | B2 * | 5/2015 | Chasteen et al. | 220/269 |
| 2002/0005408 | A1 | 1/2002 | Yamasaki et al. | |
| 2002/0113069 | A1 | 8/2002 | Forrest et al. | |
| 2002/0139800 | A1 | 10/2002 | Hwang et al. | |
| 2003/0038134 | A1 | 2/2003 | Chasteen et al. | |
| 2003/0075544 | A1 | 4/2003 | Turner et al. | |
| 2003/0098306 | A1 | 5/2003 | Cho | |
| 2003/0192889 | A1 | 10/2003 | Chasteen et al. | |
| 2004/0056032 | A1 | 3/2004 | Vaughan | |
| 2004/0099664 | A1 * | 5/2004 | Hartman | 220/269 |
| 2004/0140309 | A1 * | 7/2004 | Thibaut | 220/269 |
| 2004/0144787 | A1 | 7/2004 | Heck | |
| 2004/0188440 | A1 * | 9/2004 | Schlattl et al. | 220/253 |
| 2004/0211786 | A1 | 10/2004 | Turner et al. | |
| 2005/0077316 | A1 | 4/2005 | Roberts | |
| 2005/0115976 | A1 * | 6/2005 | Watson et al. | 220/619 |
| 2005/0224497 | A1 * | 10/2005 | Wook | 220/269 |
| 2006/0049196 | A1 * | 3/2006 | Price | 220/705 |
| 2006/0196875 | A1 | 9/2006 | Cherian | |
| 2007/0039961 | A1 * | 2/2007 | McEldowney et al. | 220/269 |
| 2007/0045318 | A1 | 3/2007 | Gibson et al. | |
| 2007/0068943 | A1 * | 3/2007 | Ramsey et al. | 220/254.3 |
| 2007/0138178 | A1 | 6/2007 | Erickson | |
| 2007/0175896 | A1 | 8/2007 | Bursztein | |
| 2007/0215621 | A1 | 9/2007 | Shinguryo et al. | |
| 2007/0257035 | A1 | 11/2007 | Berndt et al. | |
| 2008/0011786 | A1 | 1/2008 | Mathabel et al. | |
| 2008/0110888 | A1 * | 5/2008 | Turner et al. | 220/269 |
| 2008/0302793 | A1 | 12/2008 | Tirosh et al. | |
| 2009/0001081 | A1 * | 1/2009 | Schlattl et al. | 220/268 |
| 2009/0039090 | A1 | 2/2009 | Forrest et al. | |
| 2009/0039091 | A1 | 2/2009 | Forrest et al. | |
| 2009/0057315 | A1 | 3/2009 | Stringfield et al. | |
| 2009/0173740 | A1 | 7/2009 | Ferguson | |
| 2009/0194536 | A1 | 8/2009 | Ulstein et al. | |
| 2009/0200305 | A1 | 8/2009 | Stude | |
| 2009/0206083 | A1 | 8/2009 | Heigl | |
| 2009/0266824 | A1 | 10/2009 | Turner et al. | |
| 2009/0269169 | A1 | 10/2009 | Turner et al. | |
| 2010/0000997 | A1 | 1/2010 | Southers | |
| 2010/0018976 | A1 | 1/2010 | Christian et al. | |
| 2010/0044383 | A1 | 2/2010 | Watson et al. | |
| 2010/0224511 | A1 | 9/2010 | Boatner | |
| 2010/0251731 | A1 * | 10/2010 | Bergida | 62/4 |
| 2010/0294771 | A1 | 11/2010 | Holder et al. | |
| 2010/0326281 | A1 * | 12/2010 | Nishibe et al. | 99/275 |
| 2011/0056946 | A1 | 3/2011 | Emanuele, III et al. | |
| 2011/0108552 | A1 | 5/2011 | Rios | |
| 2011/0168714 | A1 | 7/2011 | Renz | |
| 2011/0226636 | A1 * | 9/2011 | Petti | 206/216 |
| 2011/0240645 | A1 * | 10/2011 | Schley et al. | 220/269 |
| 2011/0253719 | A1 | 10/2011 | Cherian | |
| 2011/0266281 | A1 | 11/2011 | Thiemann et al. | |
| 2011/0297679 | A1 | 12/2011 | Gogola et al. | |
| 2011/0303672 | A1 * | 12/2011 | Fields et al. | 220/269 |
| 2012/0012584 | A1 | 1/2012 | Chameroy et al. | |
| 2012/0031056 | A1 | 2/2012 | Chasteen et al. | |
| 2012/0048870 | A1 | 3/2012 | Ellerbe, III et al. | |
| 2012/0199586 | A1 | 8/2012 | Shamalta | |
| 2012/0199587 | A1 | 8/2012 | Norris | |
| 2012/0205378 | A1 | 8/2012 | Forrest | |
| 2012/0228296 | A1 | 9/2012 | Fields | |
| 2012/0260613 | A1 | 10/2012 | Holder et al. | |
| 2012/0312815 | A1 * | 12/2012 | Ramsey et al. | 220/212 |
| 2013/0037542 | A1 * | 2/2013 | Crothers | 220/269 |
| 2013/0037543 | A1 | 2/2013 | McClung et al. | |
| 2013/0075401 | A1 | 3/2013 | Forrest | |
| 2013/0118133 | A1 * | 5/2013 | Jacober et al. | 53/492 |
| 2013/0126529 | A1 | 5/2013 | Nesling et al. | |
| 2013/0264343 | A1 | 10/2013 | Neiner | |
| 2013/0264344 | A1 | 10/2013 | Neiner et al. | |
| 2013/0270267 | A1 * | 10/2013 | Ramsey et al. | 220/212 |
| 2013/0270269 | A1 | 10/2013 | Lewis | |
| 2013/0292382 | A1 | 11/2013 | Bork | |
| 2013/0299496 | A1 | 11/2013 | Forrest et al. | |
| 2013/0334226 | A1 * | 12/2013 | Forrest et al. | 220/273 |
| 2014/0054290 | A1 | 2/2014 | McClung et al. | |
| 2014/0054332 | A1 * | 2/2014 | Mcclung et al. | 222/541.9 |
| 2014/0069924 | A1 * | 3/2014 | Malaviya | 220/270 |
| 2014/0103044 | A1 | 4/2014 | Ramsey et al. | |
| 2014/0110408 | A1 * | 4/2014 | Mitchell et al. | 220/266 |
| 2014/0158685 | A1 | 6/2014 | Thiemann et al. | |
| 2014/0263327 | A1 * | 9/2014 | Chasteen et al. | 220/269 |
| 2014/0263333 | A1 * | 9/2014 | Keane et al. | 220/271 |
| 2014/0263334 | A1 * | 9/2014 | Scott | 220/271 |
| 2015/0136776 | A1 * | 5/2015 | Chasteen et al. | 220/269 |
| 2015/0158627 | A1 * | 6/2015 | Ramsey et al. | 220/270 |

FOREIGN PATENT DOCUMENTS

| | | |
|---|---|---|
| CN | 201343207 | 11/2009 |
| EP | 2038178 | 10/2010 |
| ES | 2458098 | 4/2014 |
| GB | 1436617 | 5/1976 |
| GB | 1532081 | 11/1978 |
| GB | 2280165 | 1/1995 |
| GB | 2291030 | 1/1996 |
| GB | 2320008 | 6/1998 |
| JP | H08-151043 | 6/1996 |
| JP | H09-58681 | 3/1997 |
| JP | H09-301364 | 11/1997 |
| JP | 10-035662 | 2/1998 |
| JP | H10-245032 | 9/1998 |
| JP | 2003285837 | 10/2003 |
| JP | 2004359339 | 12/2004 |
| JP | 2005088961 | 4/2005 |
| KR | 20050059718 | 6/2005 |
| NL | 1023297 | 11/2004 |
| WO | WO 94/13544 | 6/1994 |
| WO | WO 96/02432 | 2/1996 |
| WO | WO 97/22531 | 6/1997 |
| WO | WO 97/42088 | 11/1997 |
| WO | WO 00/56613 | 9/2000 |
| WO | WO 01/46025 | 6/2001 |
| WO | WO 2008/008892 | 1/2008 |
| WO | WO 2008/023983 | 2/2008 |
| WO | WO 2008/057207 | 5/2008 |
| WO | WO 2011/053776 | 5/2011 |
| WO | WO 2012/018549 | 2/2012 |
| WO | WO 2012/143322 | 10/2012 |
| WO | WO 2013/102594 | 7/2013 |
| WO | WO 2013/102595 | 7/2013 |

OTHER PUBLICATIONS

U.S. Appl. No. 14/066,457, filed Oct. 29, 2013, Chasteen et al.

International Search Report for International (PCT) Application No. PCT/US11/44940, mailed Dec. 22, 2011, 3 pages.

U.S. Appl. No. 29/438,299, filed Nov. 28, 2012, Jacober et al.

Written Opinion for International (PCT) Application No. PCT/US11/44940, mailed Dec. 22, 2011, 5 pages.

Official Action for Australia Patent Application No. 2011286291, dated Dec. 12, 2013 3 pages.

Official Action for U.S. Appl. No. 29/464,785 mailed Oct. 6, 2014, 4 pages.

Extended European Search Report for European Patent Application No. 11815019.2 dated Mar. 27, 2014, 7 pages.

Official Action for Canadian Patent Application No. 150953 dated Feb. 26, 2014, 2 pages.

Official Action for Canadian Patent Application No. 151227 dated Feb. 26, 2014, 2 pages.

Official Action for U.S. Appl. No. 29/437,073 mailed Apr. 9, 2014, 6 pages.

Official Action for U.S. Appl. No. 29/438,299 mailed Apr. 9, 2014, 7 pages.

(56) References Cited

OTHER PUBLICATIONS

News Releases: "The Can, ReinVented: Louisville is Pilot Market for New Bud Light Vented Can" Anheuser-Busch InBev, Jun. 5, 2013, 3 pages.
Press Release: "Crown and Molson Coors Debut Cans with New Vented End in Canada," Crown Holdings, Inc., Jul. 11, 2013, 2 pages.
Notice of Allowance for Australia Patent Application No. 2011286291, dated Apr. 3, 2014 2 pages.
Notice of Allowance (no English translation available) for Russian Patent Application No. 2013501911 dated Feb. 27, 2014, 2 pages.
Final Action for U.S. Appl. No. 12/851,979, mailed Apr. 29, 2013, 11 pages.
Notice of Allowance for U.S. Appl. No. 12/851,979, mailed Jul. 11, 2013, 8 pages.
"How Ball Makes Beverage Ends," Ball, last modified Dec. 5, 2013, 1 page [retrieved from: http://www.ball.com/images/ball_com/product_options_files/How_Ball_Makes_Beverage_Ends.pdf].
International Search Report and Written Opinion for International (PCT) Application No. PCT/US14/20821 mailed Jun. 24, 2014, 9 pages.
Official Action for U.S. Appl. No. 29/464,785 mailed Jun. 24, 2014, 7 pages.
U.S. Appl. No. 14/198,174, Mar. 5, 2014, Scott.
Notice of Allowance for U.S. Appl. No. 29/437,073 mailed Jun. 26, 2014, 10 pages.
Notice of Allowance for U.S. Appl. No. 29/438,299 mailed Jun. 26, 2014, 8 pages.
Official Action (with English translation) for Chinese Patent Application No. 201180046744.1, dated Jul. 1, 2014, 16 pages.
Notice of Allowance with English Translation for China Patent Application No. 201330161204.X, dated Oct. 16, 2013 4 pages.
Notice of Allowance with English Translation for China Patent Application No. 201330204259.4, dated Sep. 26, 2013 4 pages.
Official Action for U.S. Appl. No. 29/404,996 mailed Apr. 12, 2013, 5 pages.
Notice of Allowance for U.S. Appl. No. 29/404,996 mailed May 30, 2013, 7 pages.
U.S. Appl. No. 29/464,785, filed Aug. 21, 2013, Jacober et al.
U.S. Appl. No. 29/404,996, filed Oct. 27, 2011, Jacober et al.
U.S. Appl. No. 29/437,073, filed Nov. 13, 2012, Scott.
Official Action for Canada Patent Application No. 144505, dated Jun. 13, 2012 2 pages.
English translation of Notice of Allowance for China Patent Application No. 201230127943.2, dated Aug. 20, 2012 2 pages.
International Preliminary Report on Patentability for International (PCT) Application No. PCT/US11/44940, mailed Feb. 21, 2013, 7 pages.
International Search Report and Written Opinion for International (PCT) Application No. PCT/US12/63384 mailed Feb. 1, 2013, 8 pages.
Official Action for U.S. Appl. No. 12/851,979, mailed Sep. 28, 2012 10 pages.

* cited by examiner

SECTION A-A

SECTION A-A

SECTION A-A

SECTION A-A

SECTION A-A

SECTION B-B

SECTION B-B

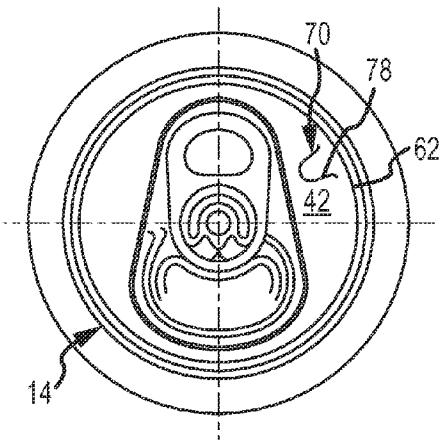
FIG.9a
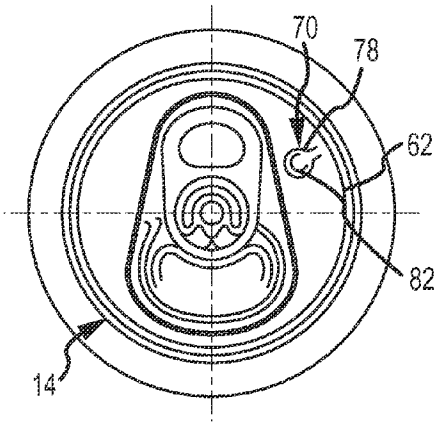
FIG.9b
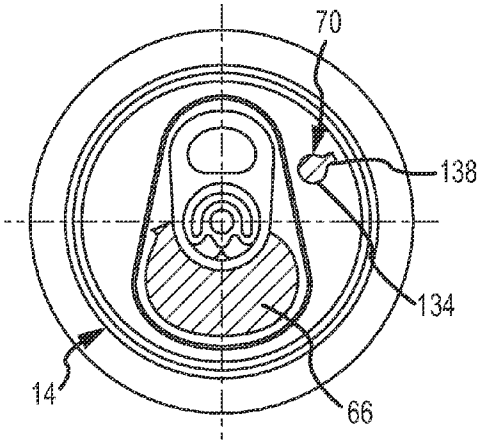
FIG.9c
FIG.9d
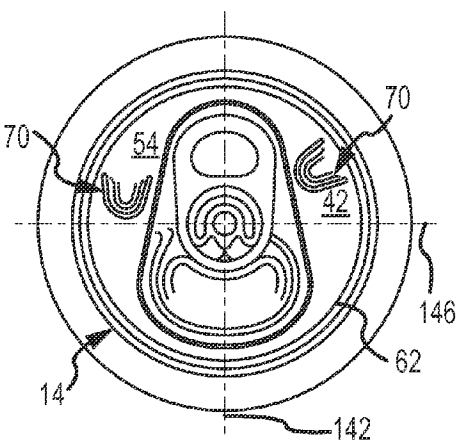
FIG.9e
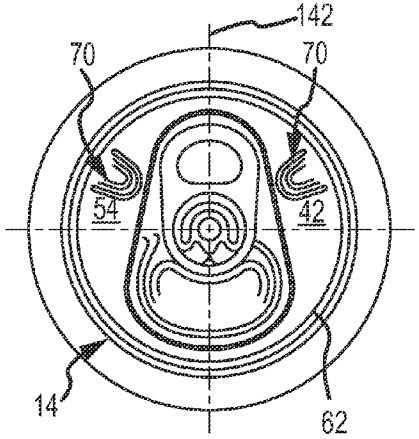
FIG.9f

VENTED METALLIC CONTAINER END CLOSURE

This application claims priority to U.S. Provisional Patent Application No. 61/555,657, filed Nov. 4, 2011, the entire disclosure of which is incorporated by reference herein.

TECHNICAL FIELD

The present invention relates generally to a metallic container end closure, and more particularly, to a vented metallic container end closure with a plurality of openings to provide enhanced flow and pourability.

BACKGROUND

Generally, the configuration of a container end closure affects the level to which end consumers, as well as bottlers, manufacturers, distributors, shippers, and retailers, are satisfied with a container. One factor believed to be of some importance to consumers is the pour characteristics of the container. In general, it is believed that consumers prefer to use containers capable of providing a relatively high pour rate. Additionally, it is believed consumers prefer containers that provide a smooth or substantially laminar pour, i.e. a pour which is not characterized by a series of surges or "glugging".

Many container configurations exist to enhance flow through a container end closure aperture. For example, some containers utilize a single large hole to admit air for venting the dispensed liquid. Examples are provided in U.S. Pat. Nos. 4,210,257; 5,007,554; 4,416,389; 4,148,410; 4,465,204; and 4,361,251; the disclosures of which are incorporated herein by reference in their entirety. Unfortunately, such larger openings tend to be associated with a higher rate of problems such as bursting, buckling, leakage, opening failures and the like, particularly when the contents are pressurized. Additionally, in configurations of large openings coupled with relatively small hinge regions, container leakage and/or separation of the panel and/or other components can be a problem upon opening. In some instances, components have been expelled from the container end closure. Furthermore, such larger openings are difficult or infeasible to provide in container ends which are relatively small.

In order to produce a more efficient, controlled flow rate, some containers utilize a tab to open two or more pour openings. This increases the flow rate of the beverage and provides better control of the liquid stream. Additionally, a second vent hole may be utilized to depressurize a container, and thus allow for easier opening of the dispensing port. This is especially advantageous for carbonated and malt beverages such as beer. Examples are provided in U.S. Pat. Nos. 4,205,760; 5,307,947; 5,397,014; 6,024,239; 6,079,583; 7,513,383; 7,748,557; 8,245,866 and U.S. Patent Application Publication Nos. 2010/0294771, 2011/0056946 and 2002/0139800; the disclosures of which are incorporated herein by reference in their entirety. However, many prior art end closures with a vent opening may be opened with finger pressure alone and utilize a score residual with a thickness which is prone to prematurely severing, and thus causing leaks or failures during stacking.

Thus, there is a need to provide a container end closure that provides enhanced pour characteristics while minimizing the likelihood of problems such as bursting, buckling, leakage, opening failures, and the like.

SUMMARY

The present invention is generally directed to systems and methods which provide metallic container end closures with a plurality of openings for improved venting and pour characteristics. The present disclosure discusses opening configurations utilizing various numbers, positions, shapes, sizes, and orientations of openings. These configurations are presented herein for purposes of description and illustration and should not be viewed as limiting the present invention to any particular embodiment or arrangement.

In accordance with one aspect of the present invention, a metallic container end closure is provided that provides a consumer with a plurality of openings. In general, the plurality of openings may vary depending on desired characteristics of the container end closure. For example, the plurality of openings may vary in number, size, shape, location, and orientation. In some embodiments, a dispensing opening provides an aperture for pouring the contents of the container, and a single vent opening provides ventilation for air flow into the container for pour control. In some embodiments, only one dispensing opening is provided, but a plurality of vent openings may also be utilized in some embodiments. The plurality of vent openings may provide apertures to vent the container to enhance product flow out of the dispensing opening, to dispense the product at varying flow rates, to accommodate a straw, and/or to allow multiple consumers to drink out of the same container without contacting the same part of the container end closure.

In addition to varying the number of openings, the size of the openings may vary. Larger openings may be included in an end closure to provide a consumer with a faster dispensing rate. Smaller openings may be included to provide container venting, thus depressurizing the container and providing enhanced pourability. Additionally, smaller openings may be used to dispense contents at a slower rate, which may be advantageous for children. Smaller openings also may be configured to selectively accommodate a straw. This configuration may be desirable for children as the smaller opening reduces the flow rate during spills and the use of a straw may increase the likelihood that the child will drink the product. In one embodiment, a large dispensing opening for dispensing the product and a small vent opening for venting the container is provided. In another embodiment, a large dispensing opening and a large vent opening is provided. In this embodiment, the consumer has two substantially equivalent dispensing options.

Various opening shapes are contemplated. For example, the opening shapes may be triangular, square, bulbous, circular, curved, and/or other shapes known in the art. Further, the shapes may be symmetrical or non-symmetrical about a plane that bisects the opening area. The shape of the opening may be chosen based on the desired flow rate and the ease of fracturing an associated score. For example, one embodiment of the present disclosure contemplates providing a score with a triangular shape, the triangular shape having a stress concentration at the apex of the triangle, thus reducing the amount of force necessary to fracture the score near the apex. Additionally, the triangular shape allows an opening tool to focalize the opening force on a smaller area near the apex as opposed to a round score shape.

The location of the openings on the end closure may vary as well. In some embodiments, a dispensing opening and a vent opening are provided. In these embodiments, the vent opening is selectively located on the container end closure so that when a container is tipped to dispense its contents out of the dispensing opening, the contents do not exit out of the vent opening. This selective location prevents spillage out of the vent opening while dispensing product out of the dispensing opening, and the location increases the smoothness of the pour by providing adequate container venting.

The orientation of the openings also may vary. In some embodiments, a dispensing opening and a vent opening is provided in which the vent opening is oriented toward the panel outer perimeter. More specifically, the score termination associated with the vent opening is directed away from the center of the end closure central panel and toward the panel outer perimeter. In this embodiment a hinge point is created, wherein the vent panel is pushed downward with an opening tool. This reduces the likelihood of a score rupture extending across the central panel of the container end closure.

In accordance with another aspect of the present invention, a metallic container end closure is provided that reduces the difficulty of opening a vent opening. In some embodiments, a stiffening structure is provided that adds stiffness to the panel area near a secondary score. The stiffening structure may have various shapes and configurations. For example, the stiffening structure may be a raised or recessed portion of the central panel, such as a bead. Alternatively, the stiffening structure can be a separate element that is coupled to the central panel. By adding stiffness to the central panel near a secondary score, the stiffening structure will reduce panel deflection and thus any downward force exerted on a secondary gate will be focused on the secondary score. Thus, the opening force required to fracture the secondary score is reduced. Alternatively, a stiffening structure may also be included on the secondary vent panel as well. Further, in some embodiments, a vent form feature is provided that increases the stiffness of the panel near a secondary score and provides a seat for an opening tool. In these embodiments, the vent form feature may have various shapes and configurations. For example, the vent form feature may be a raised or recessed portion of the panel, such as a ramp. Alternatively, the vent form feature can be a separate element that is coupled to the central panel. By adding stiffness to the central panel near a secondary score, the vent form feature reduces the opening force required to fracture a secondary score. By providing a seat for an opening tool, the vent form feature reduces slippage and increases force transfer from an opening tool to a secondary gate associated with a vent opening. Moreover, in some embodiments, a safety fold provides additional stiffness around a vent opening.

In accordance with another aspect of the present invention, a metallic container end closure is provided that reduces the chances of a consumer injury. In some embodiments, a vent opening is provided with an associated secondary score that terminates toward a panel outer perimeter. As discussed above, the orientation of the secondary score termination towards the panel outer perimeter reduces the likelihood of a score rupture extending across the central panel of the container end closure. In some embodiments, a vent opening is provided with an associated stiffening structure that extends beyond end points of an associated secondary score. In such embodiments, the stiffening structure minimizes the likelihood of a score rupture extending across the central panel of the container end closure. In some embodiments, the stiffening structure encloses a secondary score, thereby further reducing the risk of a score rupturing beyond its termination end points. In some configurations, the enclosing structure is a raised portion of the panel. In these configurations, once the secondary gate is opened, a consumer's finger contacts the raised stiffening structure and, based on the dimensions of the opening, the consumer's finger cannot contact the fractured score. To further prevent injury, in some embodiments, a safety fold is provided that provides a smooth edge around a vent opening and prevents user contact with a fractured score.

In accordance with another aspect of the present invention, a container end closure is provided that increases consumer interaction with the container. In at least one embodiment, an opening tool is provided to open a vent opening, thus allowing for the use of a score residual with a greater thickness and reducing the likelihood of a premature opening. The opening tool may be, for example, a coin, a standard church key, a customized church key, a car key, or a pen. Alternatively, finger pressure alone is sufficient for opening. Various designs of opening tools may be utilized. In some embodiments, indicium, such as a logo, is associated with a vent opening. This draws the consumer's attention to a vent opening. Further, in some embodiments, a container end closure is provided that includes an increased area for billboarding and no tab. In these embodiments, an opening tool is required to selectively open any provided opening.

In one aspect of the present invention, a vented metallic end closure adapted for interconnection to a neck of a container body is provided and, comprising a peripheral curl; a chuck wall extending downwardly from the peripheral curl; a countersink interconnected to a lower end of the chuck wall; and a central panel interconnected to the countersink, the central panel having a primary score defining a dispensing opening; a secondary score defining a vent opening with a vent panel positioned proximate to the peripheral curl of said central panel, wherein the secondary score termination is directed towards the central panel peripheral curl to form a hinge point, and said vent panel is inclined downwardly toward an interior portion of said central panel to define a ramp.

In another aspect of the present invention, a vented beverage container is provided, comprising a container body with a lower end and an upper end defined by a neck; and a metallic end closure integrally interconnected to the neck, the end closure comprising a peripheral curl, a chuck wall, a countersink, a central panel, a primary score defining a dispensing opening, and a secondary score defining a vent opening, and wherein the secondary score termination is directed towards the peripheral curl to form a hinge point, and at least a portion of said secondary vent opening is defined by an inclined panel oriented inwardly toward an interior portion of said central panel and forming a ramp to engage an opening tool.

In yet another aspect of the present invention, a method for opening a beverage container with a secondary vent opening is provided, comprising providing a container body with a lower end with a support surface and a neck on an upper end; providing a metallic end closure with a peripheral curl interconnected to the neck of said container, a chuck wall, a countersink and a central panel; providing a dispensing opening in said central panel with a first area defined by a primary score; providing a vent opening with a second area no greater than 25% of said first area and defined by a secondary score, said dispensing opening positioned proximate to an outer edge of said central panel and above a center portion of said central panel and opposite said primary score; providing a pull tab interconnected to said central panel which comprises a lift ring and a nose, said nose positioned over at least a portion of said dispensing opening; pulling said lift ring to drive said nose into said dispensing opening to shear said primary score and create the dispensing opening; positioning an opening tool over said vent opening and engaging a ramp and an inclined panel of said vent opening; applying an opening face with said opening tool to sever said secondary score and open said vent opening, wherein air is allowed to ingress into said vent opening while product is being dispensed from said dispensing opening.

As discussed herein, the container and associated container end closure generally is formed of conventional metallic materials, such as aluminum. However, a container end closure according to certain embodiments of the present invention can be formed of other materials including other metals or metal alloys, plastics, cardboard, paper, fiber reinforced materials, and the like.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The Summary is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary as well as in the attached drawings and the Detailed Description and no limitation as to the scope of the present invention is intended by either the inclusion or non-inclusion of elements, components, etc. in this Summary. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description given above and the detailed description of the drawings given below, serve to explain the principles of these embodiments. In certain instances, details that are not necessary for an understanding of the disclosure or that render other details difficult to perceive may have been omitted. It should be understood, of course, that the invention is not necessarily limited to the particular embodiments illustrated herein. Additionally, it should be understood that the drawings are not necessarily to scale.

FIGS. 9*a-f* are top plan views of various configurations of vent openings and associated features according to embodiments of the present invention;

Figure 1:
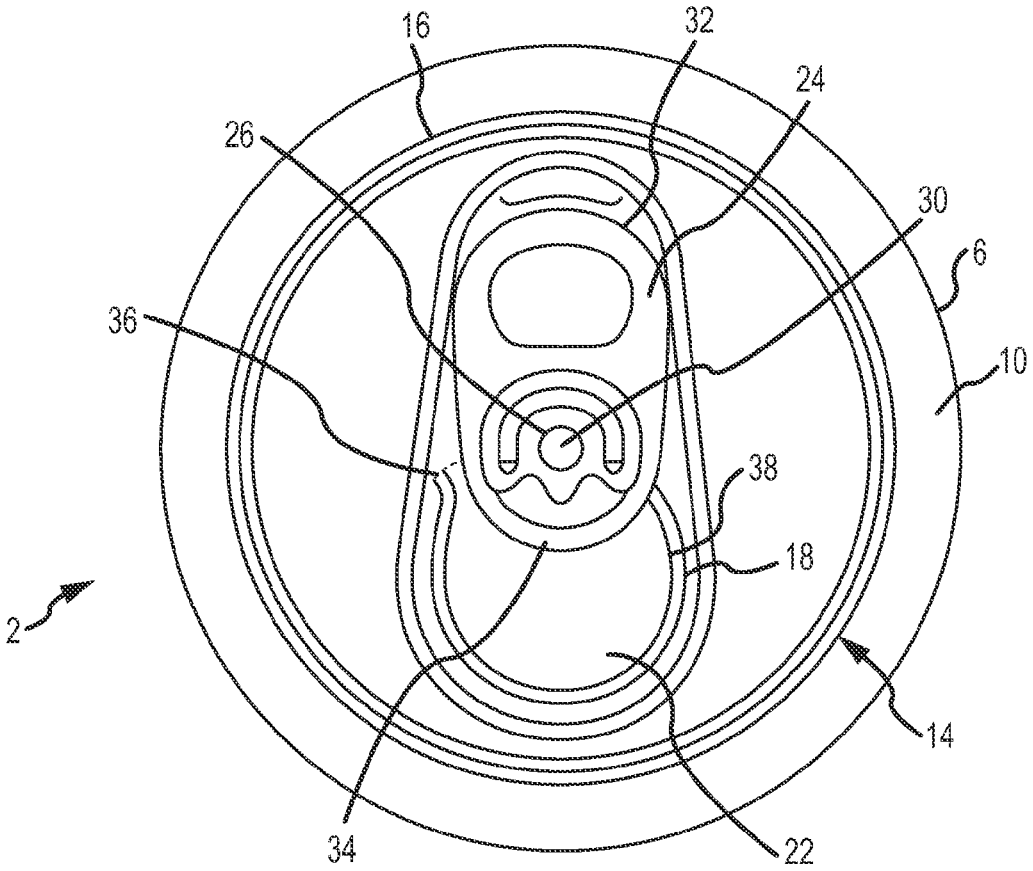
FIG. 1 PRIOR ART
FIG. 1 is a top plan view of a container according to previous devices.

To assist in the understanding of the drawings, the following is a list of components and associated numbering found in the drawings:

| # | Components |
|---|---|
| 2 | Container |
| 6 | Container body |
| 10 | Necked region |
| 14 | Container end closure |
| 16 | End closure outer perimeter |
| 18 | Score |
| 22 | Gate |
| 24 | Tab |
| 26 | Rivet |
| 30 | Pivot point |
| 32 | Rear edge |
| 34 | Forward edge |
| 36 | Gate hinge |
| 38 | Inward score |
| 42 | Upper right quadrant |

-continued

| # | Components |
|---|---|
| 46 | Lower right quadrant |
| 50 | Lower left quadrant |
| 54 | Upper left quadrant |
| 58 | Central panel |
| 62 | Panel outer perimeter |
| 66 | Dispensing opening |
| 68 | Debossed area |
| 70 | Vent opening |
| 74 | Stiffening structure |
| 78 | Secondary score |
| 82 | Vent form feature or panel |
| 86 | Secondary gate |
| 90 | Secondary gate hinge |
| 94 | Secondary score end point |
| 98 | Secondary score end point |
| 106 | Stiffening structure end point |
| 110 | Stiffening structure end point |
| 112 | First segment |
| 114 | Second segment |
| 116 | Countersink |
| 118 | Inner panel wall |
| 120 | Outer panel wall |
| 122 | Chuck wall |
| 124 | Peripheral seam |
| 126 | Residual |
| 128 | Finger |
| 130 | Safety fold |
| 132 | Edge |
| 134 | Circular portion |
| 138 | Stem portion |
| 142 | Axis |
| 146 | Axis |
| 150 | Indicia |
| 154 | Primary gate hinge |
| 158 | Church key |
| 162 | Handle |
| 166 | Claw |
| 170 | Forward end |
| 172 | Ramp |
| 174 | Lip portion |
| 176 | Vent panel length |

DETAILED DESCRIPTION

Unless otherwise indicated, all numbers expressing quantities of ingredients, dimensions, reaction conditions, and so forth used in the specification and claims are to be understood as being modified in all instances by the term "about".

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Referring to FIG. 1, a top plan view of a prior art container is shown. In the container 2 of FIG. 1, a container body 6 is provided with a necked region 10 leading to a body end which is covered, in the depicted embodiment, with a container end closure 14. Manners of forming container bodies and container ends and of attaching or coupling the two, to form the depicted device, are well known in the art.

The container end closure 14 generally has an end closure outer perimeter 16 and includes a score 18 commonly formed by stamping with a die or "knife" to define a gate 22. A tab 24 is coupled to the container end closure 14, for example, by a rivet 26 whose center defines a pivot point 30. Generally, lifting the rear edge 32 of the tab 24 up and towards the gate 22 results in the forward edge 34, or nose, of the tab 24 pressing downward on part of the gate 22 with sufficient force to cause a rupture to form along the score 18, permitting the gate 22 to bend or pivot inward about a gate hinge 36 defined between the end points of the score 18. Once the gate 22 has been pivoted inward, the container end closure 14 has a dispensing opening 66 whose perimeter is defined by the score 18 and the gate hinge. In the depicted configuration, a second inward "anti-fractive" score 38 is positioned substantially parallel with the rupture score 18. The interior score 38 has been found useful in protecting the rupture score 18; however, no rupture occurs along the interior score 38 in normal operation.

Figure 2:
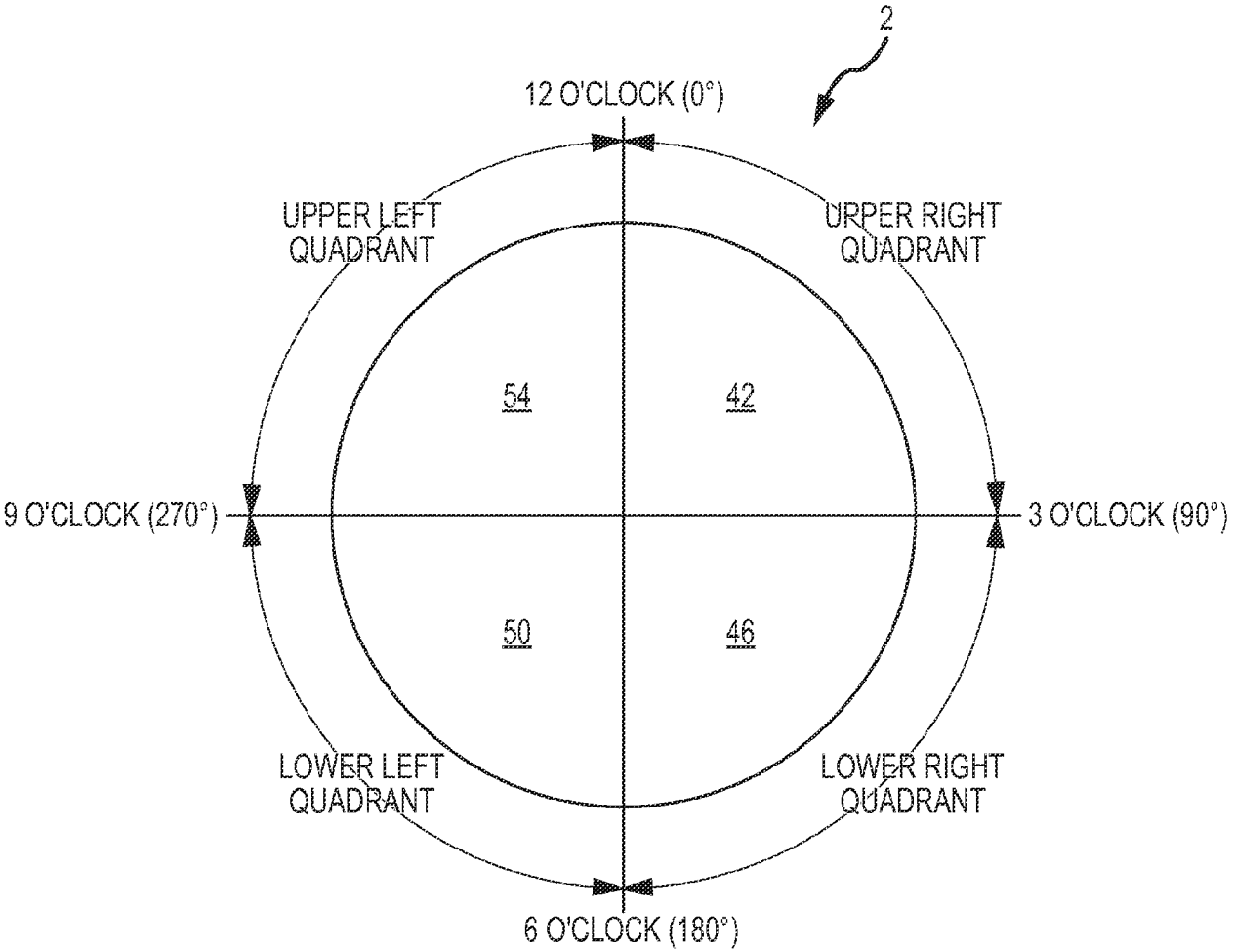
FIG. 2 is a top plan view of a container depicting quadrant zones.

Referring now to FIG. 2, a top plan view is provided of a container 2 segmented into four quadrant zones. The quadrant zones are used for description purposes and will be referenced throughout the disclosure. As shown in FIG. 2, the container 2 has an upper right quadrant 42, a lower right quadrant 46, a lower left quadrant 50, and an upper left quadrant 54. Each quadrant has the same shape and size. It will be recognized that the referenced quadrants are provided primarily for illustration purposes and no limitation or specific structural division is implied by FIG. 2. However, the vent openings 70 described herein are generally oriented within the upper right and upper left quadrants where the score lines are positioned in the lower left and lower right quadrants. Preferably the vent openings are positioned between about 20-70 degrees from the Y axis in each quadrant. Further, the vent openings are positioned in a location which is generally offset from the left end of the pull tab to prevent inadvertent opening if the pull tab was inadvertently pushed downward on the vent opening.

Figure 3A:
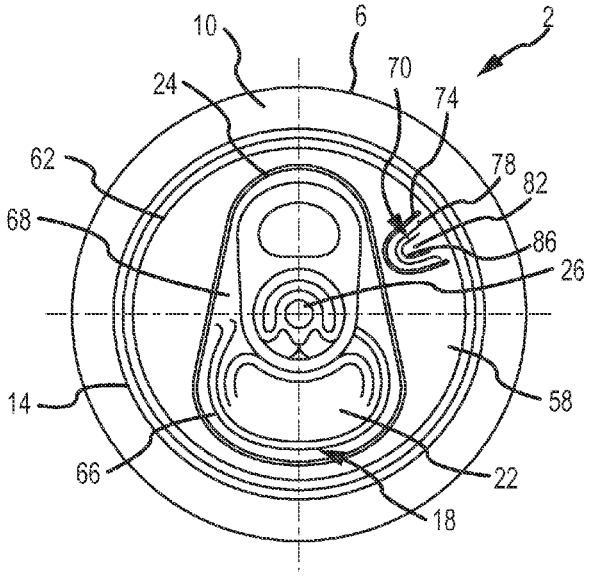
FIG. 3*a* is a top plan view of a container end closure according to an embodiment of the present invention.

Referring to FIG. 3*a*, a top view of a container end closure according to an embodiment of the present invention is provided. In FIG. 3*a*, a container 2 includes a container body 6 with a necked region 10 and a container end closure 14. The container end closure 14 includes a central panel 58 with a radius 62, and the panel has a dispensing opening 66 and a vent opening 70. The dispensing opening 66 shown in FIG. 3*a* is associated with a score 18, a gate 22, a tab 24, a rivet 26, and a recessed or debossed area 68. As illustrated, the tab 24 is positioned for bending the gate 22 inward, thus opening the dispensing opening 66. In this embodiment, the dispensing opening 66 is included to quickly dispense the contents of the container 2.

The vent opening 70 is associated with various features including a reinforcing or stiffening structure 74, such as a raised or recessed support bead, a secondary score 78, and a vent form feature 82, which will be discussed in more detail in connection with FIG. 6. The reinforcing or stiffening structure 74 provides stiffness to the vent opening 70 to ease opening of the vent opening and assists in preventing a tear from propagating across the central panel 58. Although stiffening in this region can take a number of forms, in the depicted embodiment, the stiffening structure 74 generally comprises a u-shape, which is the same general shape as the secondary score 78. In this embodiment, the vent opening 70 provides a vent for the container. The vent opening allows a consumer to depressurize a container 2 before opening the dispensing opening 66, which provides easier opening of the dispensing opening 66 and enhanced pourability through the dispensing opening 66. Additionally, the vent opening 70 may be selectively sized to accommodate a straw. In this configuration, a consumer may choose to consume the contents of the container 2 through a straw disposed within the vent opening 70, thus making the opening of the dispensing opening 66 unnecessary. Further, in some embodiments the vent panel positioned within the secondary score 78 may include a stiffening structure 74 or support bead to prevent tearing.

Figure 3B:
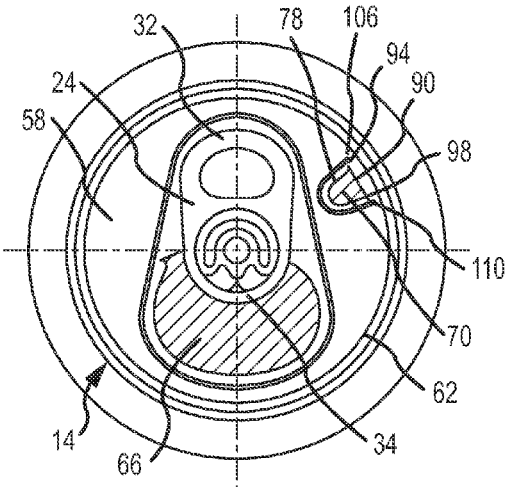
FIG. 3*b* is another top plan view of the container end closure of FIG. 3*a* depicting opening areas of a dispensing opening and a vent opening.

Referring to FIG. 3*b*, the container end closure 14 of FIG. 3*a* is illustrated with a dispensing opening 66 and a vent opening 70 both opened. To open the dispensing opening 66, a consumer pulls upward on the rear edge 32 of the tab 24 to cause the forward edge 34, or nose, of the tab 24 to contact the gate 22 and rupture the score 18, as discussed in more detail above in connection with FIG. 1. To open the vent opening, a consumer generally utilizes an opening tool, such as a coin or a church key, although finger pressure is sufficient in some embodiments. The opening tool presses downward on at least a portion of the secondary gate 86 with sufficient force to cause a rupture to form along the secondary score 78, permitting the secondary gate 86 to bend or pivot inward about a secondary gate hinge 90 defined between the end points 94, 98 of the secondary score 78. The bending or pivoting of the secondary gate 86 opens the vent opening 70, whose perimeter is defined by the secondary score 78 and the secondary gate hinge 86.

As depicted, endpoints 106, 110 of the stiffening structure 74 are positioned substantially adjacent or beyond the endpoints of the 94, 98 of the secondary score 78 to assist in avoiding propagation of a rupture beyond the secondary score end points 94, 98 and across the central panel 58. Additionally, the secondary score 78 termination is towards the panel outer perimeter 62 to further minimize the likelihood of propagation of a rupture across the central panel 58. These safety features allow score propagation to terminate not farther from center than the panel outer perimeter 62 and thus not propagate across the main panel area.

As illustrated in FIG. 3*b*, the vent opening 70 may be located in the upper right quadrant 42 and may be smaller than the dispensing opening 66. The vent opening's 70 location and smaller size keeps the contents of the container 2 from dispensing through the vent opening 70 when drinking from the dispensing opening 66. For example, in FIG. 3*b*, the dispensing opening 66 is located in the lower right quadrant 46 and the lower left quadrant 50. To drink from the dispensing opening 66, a consumer would position the dispensing opening 66 close to their mouth and tip the bottom of the container 2 upward. In this method of use, the contents of the container 2 would be dispensed through the dispensing opening 66 and the vent opening 70 would operate as a vent to increase the pourability of the container contents. In at least one embodiment, the size of the vent opening 70 is approximately five percent of the area of the dispensing opening 66 to provide adequate venting while preventing contents from dispensing through the vent opening 70 when drinking from the dispensing opening 66. In some embodiments, the vent opening 70 may be located in the same quadrant as the dispensing opening 66. In these embodiments, the vent opening 70 operates as a slower dispensing rate option as compared to the dispensing opening 66. Additionally, the vent opening 70 may be selectively sized to accommodate a straw.

In some embodiments, the dispensing opening 66 is the primary mode of failure relative to the vent opening 70. The failure mode is based on at least two design criteria, the size of the opening and the score residual. As discussed above, in at least one embodiment, the vent opening 70 is smaller than the dispensing opening 66. As such, the smaller vent opening 70 has a lower force exerted on it by the pressurized container than the larger dispensing opening 66. Based on the lower force exerted on the smaller vent opening 70, the smaller vent opening 70 would require an extremely high internal pressure, higher than currently available carbonated drink pressures, to allow it to be the primary mode of failure unless the score residual of the smaller vent opening 70 was proportionally less than the score residual of the larger dispensing opening 66. As will be appreciated by one of skill in the art, the secondary score residual and the primary score residual may be varied to alter the primary mode of failure. In some embodiments, the secondary score residual is approximately the same thickness as the primary score residual to about 0.0005 inches less than the primary score residual. Further, plastisol or other adhesives may be used to minimize the chance for score fractures when the score is required to be deeper to aid in easier opening.

Figure 3C:
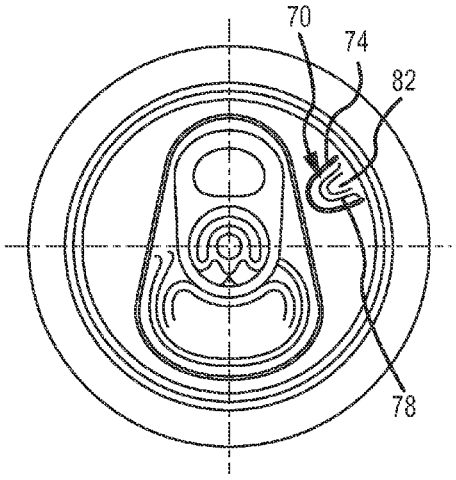
FIG. 3*c* is a related embodiment to FIG. 3*a* with a modified vent opening.

Referring to FIG. 3*c*, a modified vent opening 70 is depicted according to another embodiment of the present invention. As shown, the position of the secondary score 78 relative to the stiffening structure 74 and the vent form feature 82 is different as compared to FIG. 3*a*. More specifically, the distance between the stiffening structure 74, the secondary score 78, and the vent form feature 82 is greater in FIG. 3*c* than in FIG. 3*a*. By altering the design of the stiffening structure 74 and the vent form feature 82, various configurations of the vent opening 70 may be utilized according to embodiments of the present invention.

In accordance with embodiments of the present invention, various shapes and configurations of the stiffening structure 74 may be utilized, including symmetrical and non-symmetrical stiffening structures 74. Referring to FIG. 4*a*, an embodiment of a container end closure 14 is provided with a non-symmetrical stiffening structure 74. As depicted, stiffening structure 74 is not symmetrical about line A-A. More particularly, a first segment 112 of the stiffening structure 74 is closer to the line A-A than a second segment 114 of the stiffening structure 74. Various factors including the desired opening force required to rupture the secondary score, the design of the vent form feature 82 and the orientation of the vent opening 70 relative to the panel outer perimeter 62 will determine the configuration and shape of the stiffening structure 74.

Figure 4B:
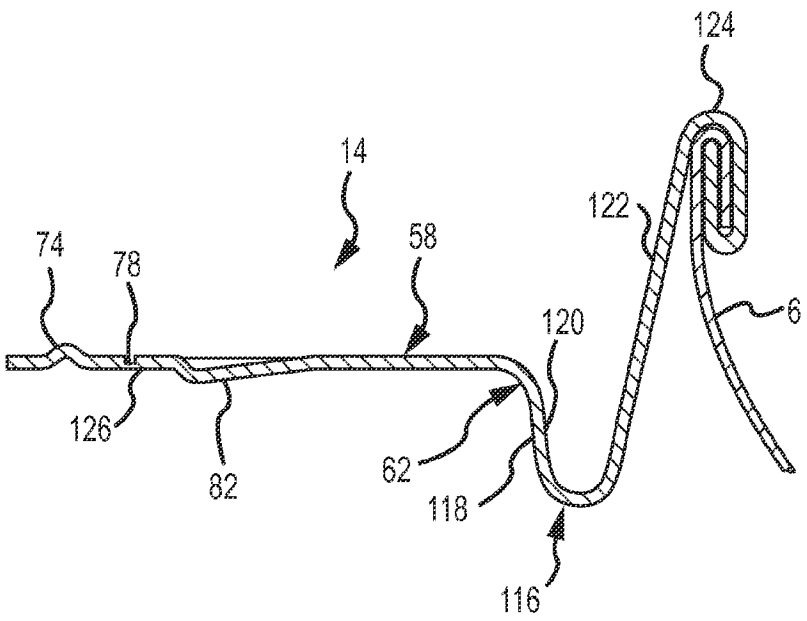
FIG. 4*b* is a partially fragmented section view taken along line A-A of FIG. 4*a;*
Figure 4A:
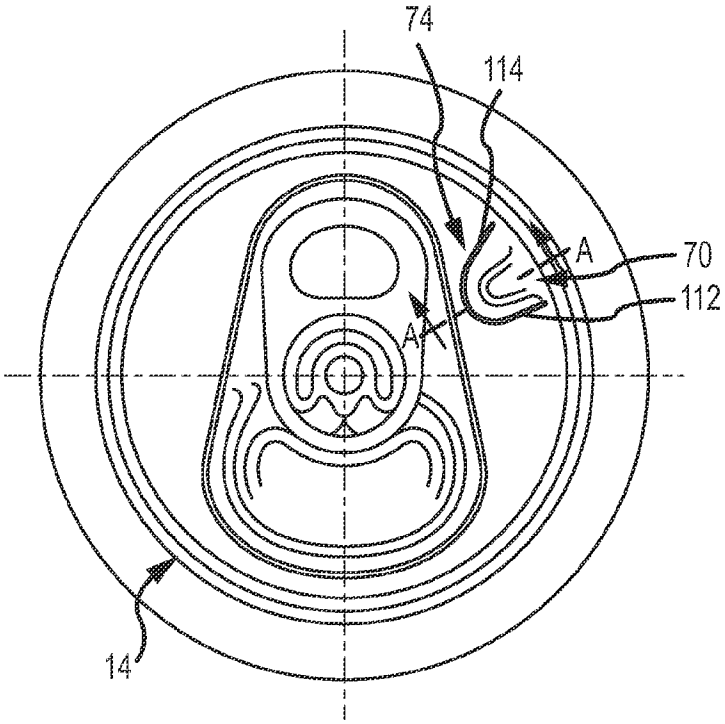
FIG. 4*a* is a top plan view of a container end closure with a non-symmetrical stiffening structure according to an embodiment of the present invention.

FIG. 4*b* is a partially fragmented section view taken along line A-A of FIG. 4*a*. As illustrated in FIG. 4*b*, a container end closure 14 is interconnected to a container body 6. The container end closure 14 includes a central panel 58 interconnected to a countersink 116 having an inner panel wall 118 and an outer panel wall 120, which is in turn interconnected to a chuck wall 122 and a peripheral seam 124. Before interconnection to a container body, the container end closure has an outer edge formed into a peripheral curl. Upon interconnection, the peripheral curl is formed into a peripheral seam 124. As depicted, the central panel 58 includes a stiffening structure 74, a score 78, a residual 126, a vent form feature 82, and a panel outer perimeter 62. In the illustrated embodiment, the stiffening structure 74 is a raised bead and the vent form feature 82 is a recessed portion of the panel. The score 78 is disposed between the stiffening structure 74 and the recessed vent form feature 82. In general, the design of the stiffening structure 74, the score 78, and the vent form feature 82 affects the opening force required to fracture the score 78. For example, the positioning and the shape of the vent form feature 82 relative to the score 78 will focalize an opening force, thereby making the score 78 easier to fracture. Additionally, the more rigid the stiffening structure 74 makes the area proximate to the score 78, the easier it will be to open the vent opening 70. Further, the shape of the score 78 affects the opening force. For example, a triangular score 78 will allow an opening tool to focus the opening force on a smaller area near the apex of the triangle formed by the score 78 as opposed to a round-shaped score.

Figure 5:
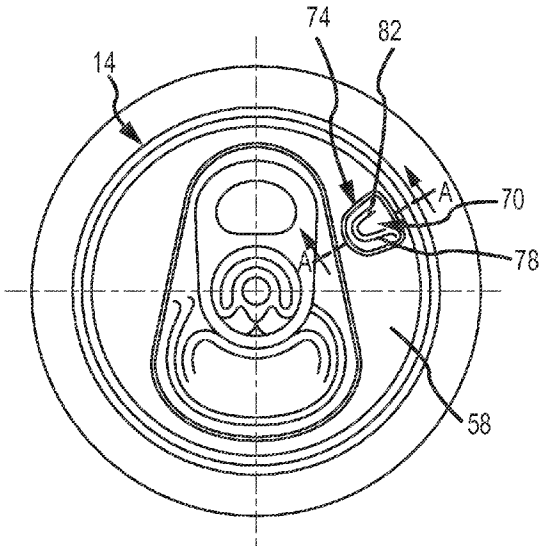
FIG. 5 is a top plan view of a container end closure with a score enclosed within a stiffening structure according to an embodiment of the present invention.

Referring to FIG. 5, an embodiment of a container end closure 14 is provided with a secondary score 78 enclosed within a stiffening structure 74. As illustrated, the secondary score 78 and the vent form feature 82 are enclosed within the stiffening structure 74. In this configuration, the stiffening structure 74 provides additional stiffness and rigidity to the vent opening 70. Accordingly, a force exerted near or on the form feature 82 will be focused on the secondary score 78, thus making it easier to open the vent opening. By enclosing the score, the stiffening structure 74 also minimizes the likelihood of rupture of the score 78 beyond the predetermined score 78 or stiffening structure 74. If the stiffening structure 74 includes a raised bead, enclosing the secondary score 78 within the stiffening structure 74 will provide additional safety features that will be discussed in detail in connection with FIGS. 7*a-b*.

Figure 6A:
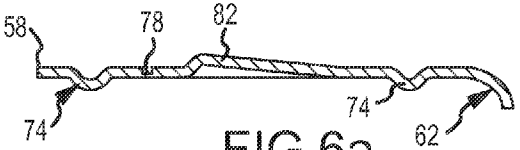
FIGS. 6*a-d* are partially fragmented section views taken along line A-A of FIG. 5 depicting various configurations of vent form features according to an embodiment of the present invention.
Figure 6B:
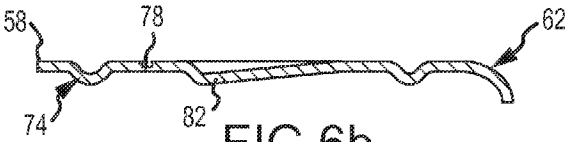
Figure 6C:
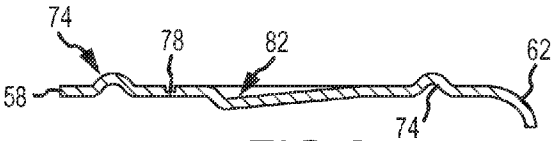
Figure 6D:
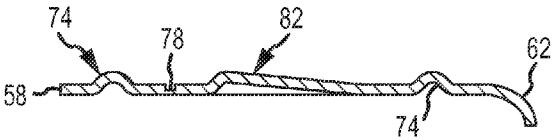

FIGS. 6*a-d* are partially fragmented section views taken along line A-A of FIG. 5 and illustrate various configurations of stiffening structures 74 and vent form features 82 according to embodiments of the present invention. In general, the stiffening structures 74 and vent form or panel features 82 are designed to make the vent opening easier to open, eliminate the likelihood of a rupture across the panel 58, and provide other safety features discussed herein. Referring to FIG. 6*a*, the stiffening structure 74 is a recessed bead that encloses the secondary score 78 and the vent form feature 82, which is shown as a raised ramp. The secondary score termination is directed away from a center of the central panel and towards the panel outer perimeter 62. Referring to FIG. 6*b*, the vent form feature 82 is a recessed ramp. As either a raised or recessed ramp, the vent form feature 82 provides a seat for an opening tool to exert force on the secondary gate and stiffens the area near the secondary score 78 to allow an opening force to be focused on the score 78. In FIG. 6*c*, a raised bead stiffening structure 74 is provided along with a recessed ramp vent form feature 82. In FIG. 6*d*, a raised bead stiffening structure 74 is provided along with a raised ramp vent form feature 82. As illustrated in FIGS. 6*a-d*, various combinations of stiffening structures 74 and vent form features 82 may be utilized.

As shown in FIGS. 6*a*-6*d*, a vent form feature or panel 82 comprises a ramp portion 172 positioned between a vent form feature 82 connected to a central panel 58. The ramp portion 172 connects the vent form feature to a remainder of the central panel. In the embodiments of FIGS. 6*b* and 6*c*, the ramp 172 extends upwardly to connect a recessed feature to the panel 58. In alternative embodiments, and as shown in FIGS. 6*a* and 6*d*, the ramp 172 extends downwardly to interconnect a raised feature to the panel 58.

Figure 7A:
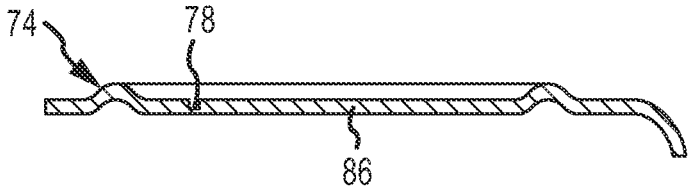
FIGS. 7*a-b* are side elevation views of a stiffening structure along with an associated safety feature according to an embodiment of the present invention.
Figure 7B:
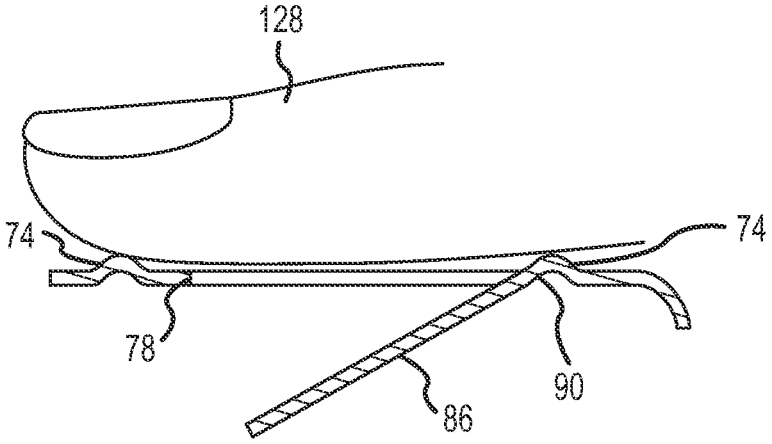

FIGS. 7*a-b* depict a safety feature of a stiffening structure according to an embodiment of the present invention. Referring to FIG. 7*a*, a stiffening structure 74, illustrated as a raised bead, encloses a secondary score 78, and a secondary gate 86 is closed. In FIG. 7*b*, the secondary gate 86 has been bent inward about a secondary gate hinge 90, thus opening the vent opening and exposing a fractured edge of the score 78. As illustrated, the stiffening structure 74 provides rigidity to the gate hinge 90 and provides protection against the score 78 extending beyond the stiffening structure 74. Further, the stiffening structure 74 prevents a finger from contacting the exposed edge of the score 78. As depicted, a consumer's finger 128 contacts the stiffening structure 74, thus preventing the finger 128 from contacting the fractured edge of the score 78. This safety feature reduces the risk of a finger laceration.

Figure 8A:
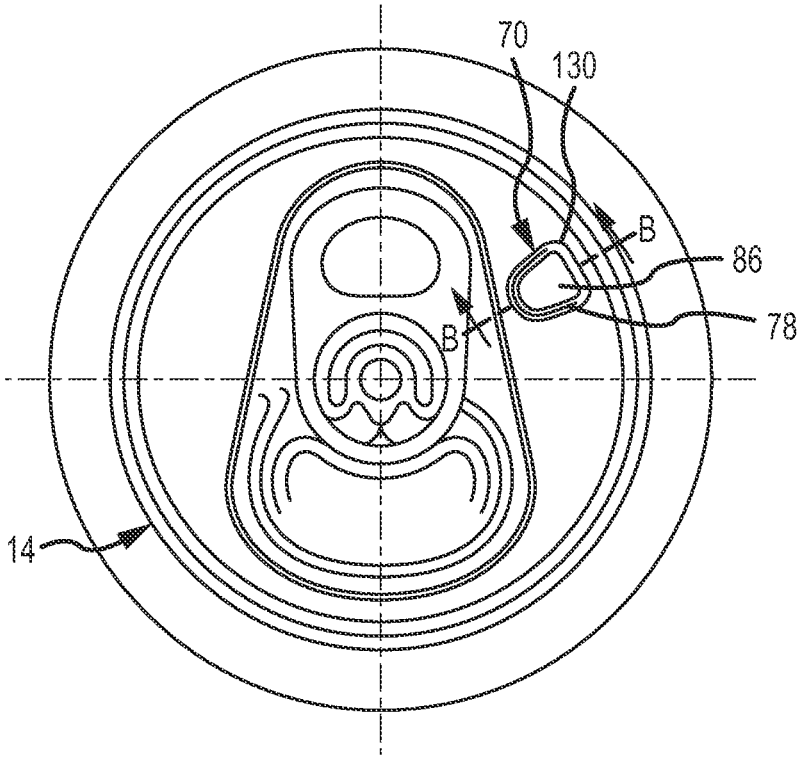
FIGS. 8*a-c* are views of a vent opening utilizing a safety fold according to an embodiment of the present invention.
Figure 8B:
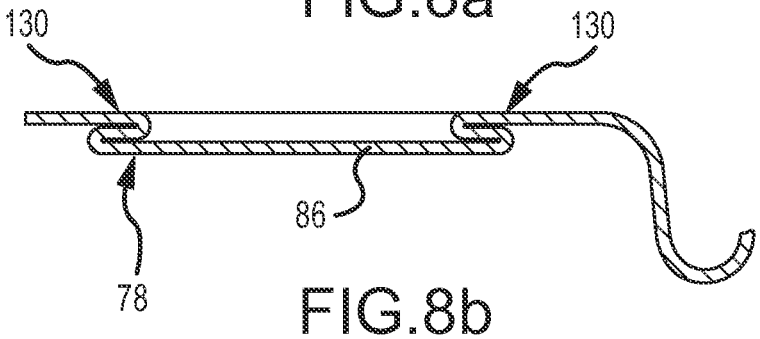
Figure 8C:
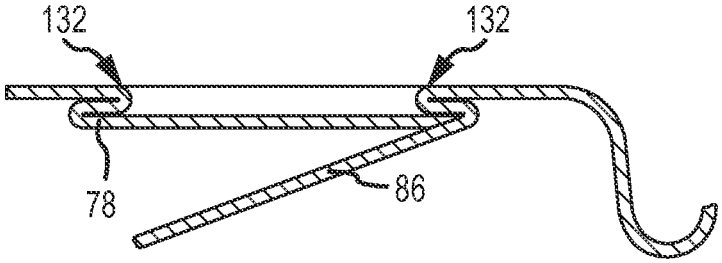

FIGS. 8*a-c* depict a safety fold 130 according to an embodiment of the present invention. Referring to FIG. 8*a*, a container end closure 14 includes a vent opening 70 associated with a secondary score 78, a secondary gate 86, and a safety fold 130. As shown in FIG. 8*b*, the secondary gate 86 is in a closed position, and the secondary score 78 is formed beneath a safety fold 130. Applying a downward force on the gate 86 fractures the score 78 and bends the gate 86 inward. As shown in FIG. 8*c*, once the gate is bent inward, an edge 132 of the safety fold 130 protects a consumer from a fractured edge of the score 78.

Referring to FIGS. 9*a-f*, various configurations of vent openings and associated features according to embodiments of the present invention are provided. FIG. 9*a* illustrates a vent opening 70 located in the upper right quadrant of a container end closure 14. In FIG. 9*a*, the vent opening 70 has a generally u-shaped secondary score 78 that terminates toward the panel outer perimeter 62. In this configuration, no stiffening structure 74 or vent form feature 82 is provided. FIG. 9*b* illustrates a vent opening 70 having a generally bulbous-shaped secondary score 78, similar to the shape of an incandescent light bulb, and a vent form feature 82. As illustrated the secondary score 78 terminates toward the panel outer perimeter 62. Although a stiffening structure 74 is not shown in FIG. 9*b*, a stiffening structure 74 may be provided in some embodiments. The generally bulbous-shaped secondary score 78 depicted in FIG. 9*b* may be particularly suited for accommodating straws. As shown in FIG. 9*c*, the dispensing opening 66 and a vent opening 70 have been opened. The vent opening 70 has a circular portion 134 along with a stem portion 138. In some configurations, the circular portion 134 is designed to snugly accommodate a straw and the stem portion 138 provides a vent to enhance the flow of contents up the straw. In these configurations, the dispensing opening 66 is not necessary for dispensing container contents and, if provided, the consumer may elect not to open the dispensing opening 66.

Referring to FIG. 9*d*, a container end closure 14 is provided with two vent openings 70, one located in an upper right quadrant 42 and the other located in an upper left quadrant 54. As illustrated, the vent openings 70 have different shapes and associated features. However, as shown, both of the vent openings 70 are directed towards the panel outer perimeter 62.

Referring to FIG. 9*e*, a container end closure 14 is provided with two vent openings 70, one located in an upper right quadrant 42 and the other located in an upper left quadrant 54. As illustrated, the vent openings 70 are identical in shape and associated features. However, the vent openings 70 are not symmetrical about a bisecting axis 142. More specifically, the location and orientation of the vent openings 70 within their respective quadrants are different. As shown, the vent opening 70 associated with the upper left quadrant 54 is located closer to bisecting axis 146 than the vent opening 70 associated with the upper right quadrant 42. Additionally, the vent opening 70 associated with the upper left quadrant 54 is not oriented towards the panel outer perimeter 62 as is the vent opening 70 associated with the upper right quadrant 42.

Referring to FIG. 9*f*, a container end closure 14 is provided with two vent openings 70, one located in an upper right quadrant 42 and the other located in an upper left quadrant 54. As illustrated, the vent openings 70 are identical in shape and associated features, and are symmetrical about a bisecting axis 142.

Figure 10C:
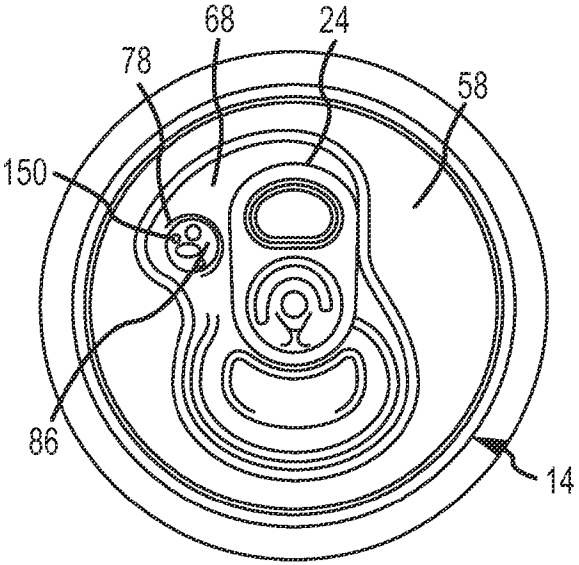
FIGS. 10*a-c* are top plan views of further configurations of vent openings and associated features according to embodiments of the present invention.
Figure 10B:
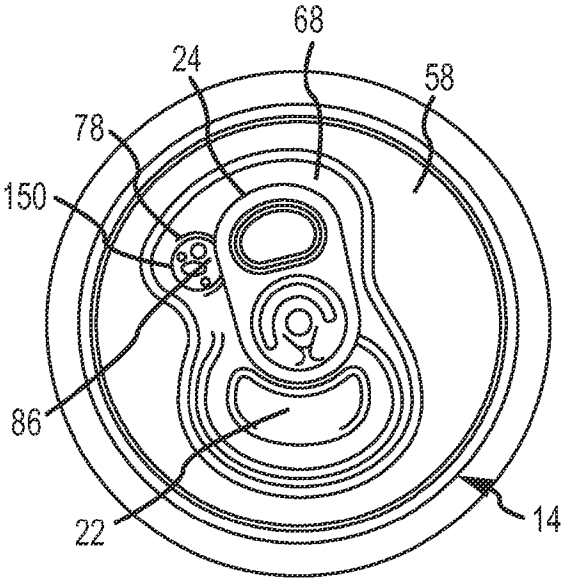
Figure 10A:
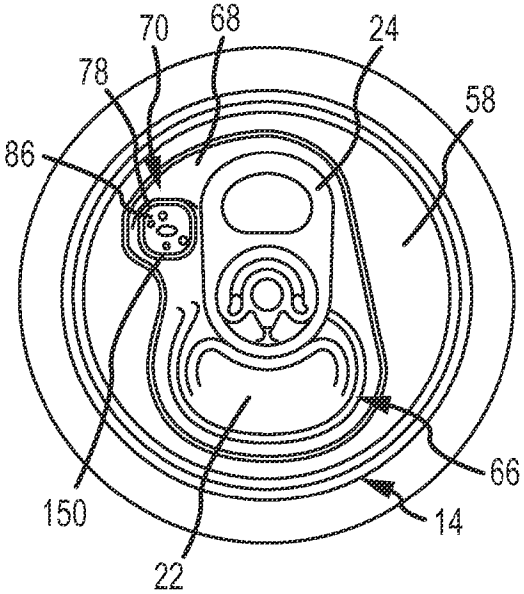

FIGS. 10*a-c* depict further configurations of vent openings and associated features according to embodiments of the present invention. As shown in FIGS. 10*a-c*, a container end closure 14 is provided having a vent opening 70 disposed within a debossed area 68. As illustrated, the vent opening 70 is associated with a secondary score 78 and indicia 150, such as a logo. The indicia 150 is disposed on at least a portion of a secondary gate and focuses the attention of the consumer on the flow enhancement feature 70. The indicia 150 may be printed, embossed, debossed, or incised on the end closure 14. Additional methods known in the art are also contemplated. As illustrated, a tab 24 is positioned over a gate 22 that is associated with a dispensing opening 66. In some embodiments, the vent opening 70 is selectively positioned on the end closure 14 to allow the tab 24 to open the vent opening 70. In other embodiments, the vent opening 70 is selectively positioned on the end closure 14 out of reach of the tab 24, and an opening tool is required to open the vent opening 70.

Figure 11A:
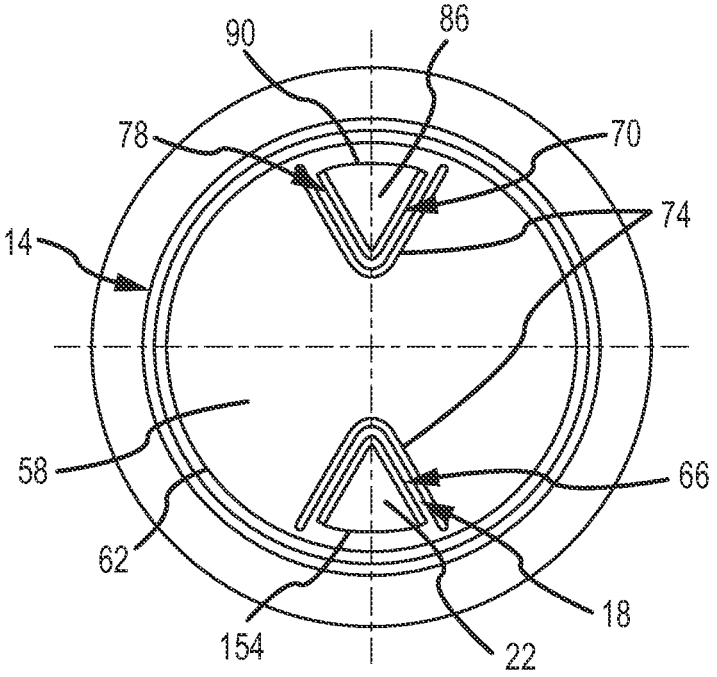
FIGS. 11*a-b* are top plan views of a container end closure not utilizing a pull tab according to an embodiment of the present invention.
Figure 11B:
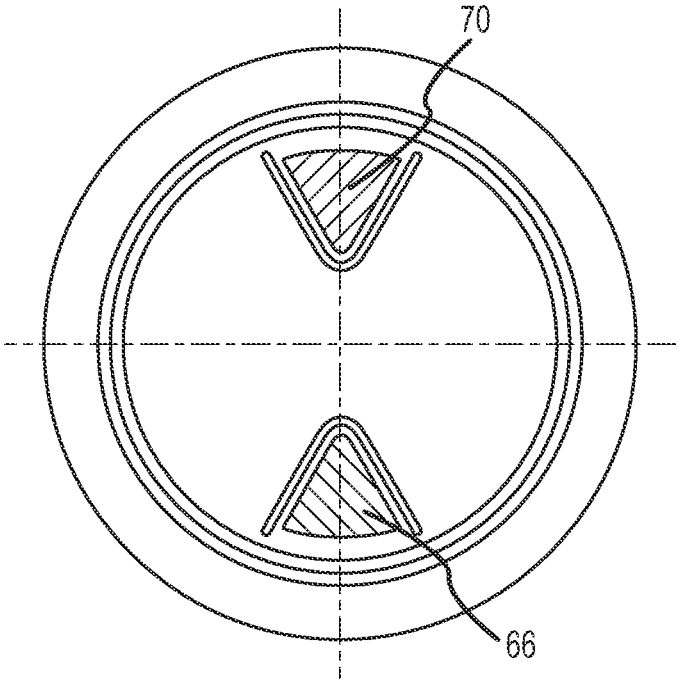

Referring to FIGS. 11*a-b*, embodiments of a container end closure 14 are provided that do not utilize a tab. As illustrated in FIG. 11*a*, the container end closure 14 contains a dispensing opening 66 and a vent opening 70 that are identical in shape, size, and associated features. The dispensing opening 66 is associated with a score 18, a gate 22, a primary gate hinge 154, and a stiffening structure 74. The vent opening 70 is associated with a secondary score 78, a secondary gate 86, a secondary gate hinge 90, and a stiffening structure 74. As depicted, both the primary score 18 and the secondary score 78 terminate away from a center of the central panel 58 and towards the panel outer perimeter 62. As will be appreciated by one of skill in the art, the hinge may vary with the size of the opening, and the hinge may be located in any of the four quadrants or any combination of quadrants. FIG. 11*b* illustrates a dispensing opening 66 and a vent opening 70 after the gate 22 and the secondary gate 86 have been bent inward by an opening tool.

Figure 12A:
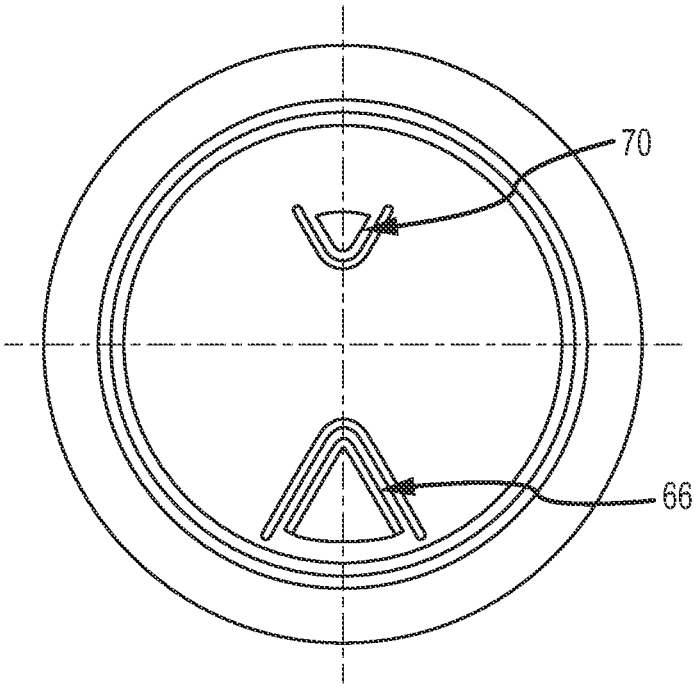
FIGS. 12*a-b* are top plan views of the container end closure of FIGS. 10*a-b* with varying opening sizes.
Figure 12B:
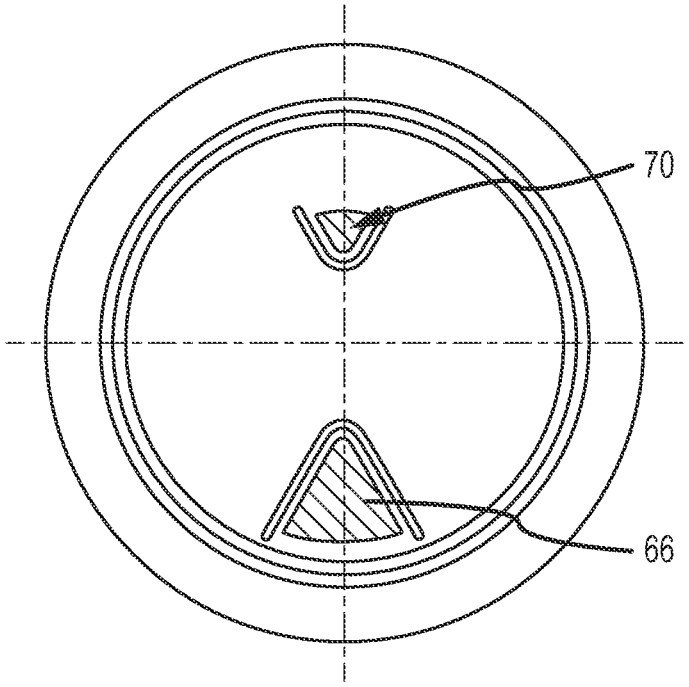
Figure 13A:
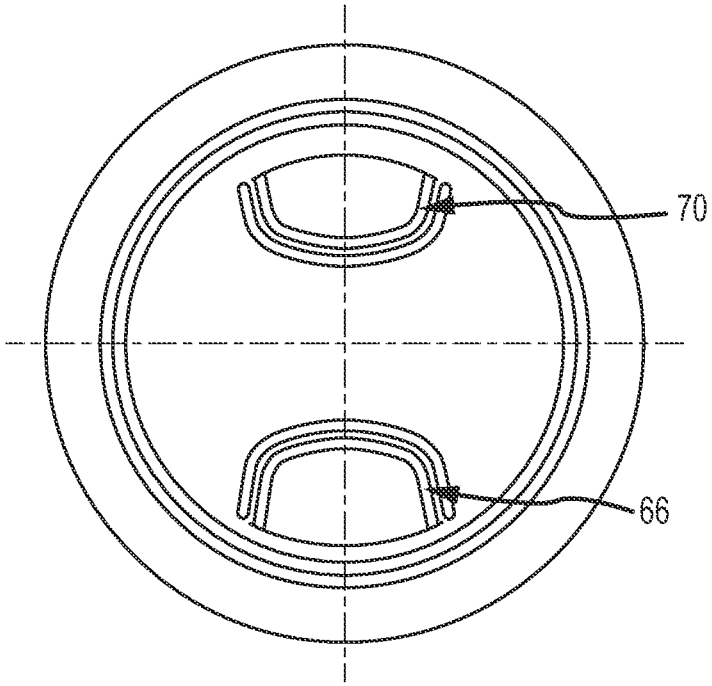
FIGS. 13*a-b* are top plan views of the container end closure of FIGS. 10*a-b* with generally u-shaped openings.
Figure 13B:
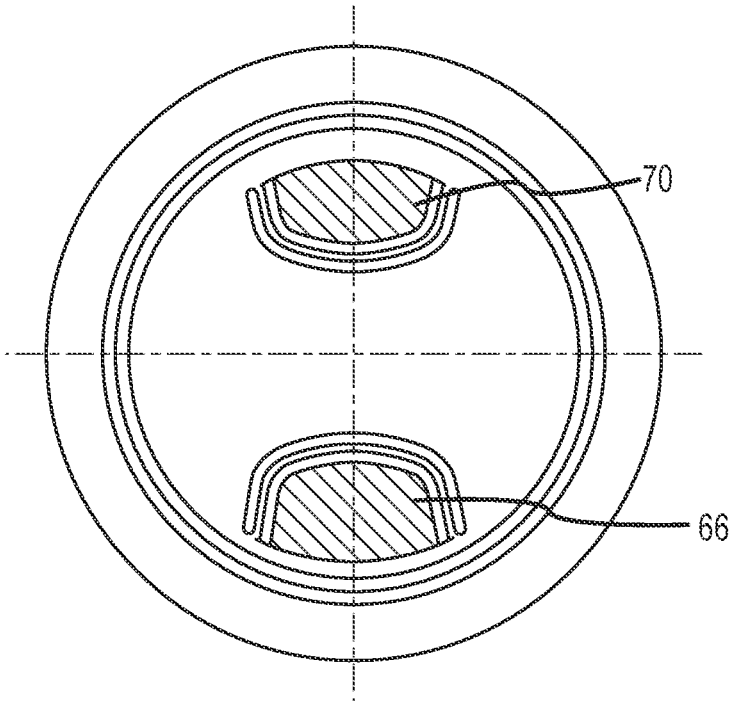

Referring to FIGS. 12*a-b*, the vent opening 70 has the same general triangular shape and associated features as the dispensing opening 66; however, the vent opening 70 is smaller in size than the dispensing opening 66. The triangular shape allows an opening tool to focus a downward force near the apex of the triangle, thus fracturing the score more easily. Referring to FIGS. 13*a-b*, the dispensing opening 66 and the vent opening 70 are similar in size, have the same associated features, and are generally u-shaped. The u-shape opening provides a larger opening as compared to the triangular shape. The u-shaped opening also provides a greater safety factor over the triangular shape because the u-shaped opening does not have an apex with a sharp focal point.

Figure 14:
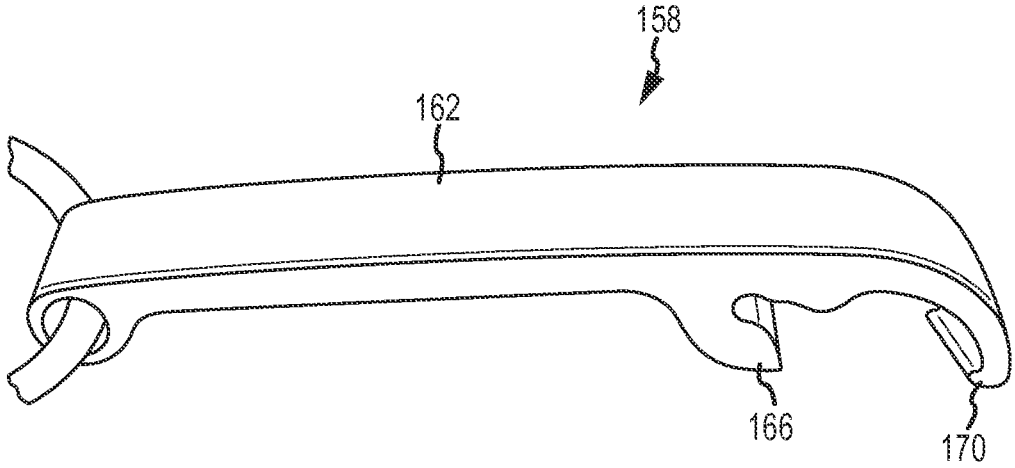
FIG. 14 is a perspective view of an opening tool according to an embodiment of the present invention.

FIG. 14 is a perspective view of an opening tool according to an embodiment of the present invention. In FIG. 14, a customized church key 158 is provided that may be utilized to open a secondary gate 86 associated with a vent opening 70. The customized church key 158 has a handle 162 that acts as a lever, a claw 166 to grip the peripheral seam of a container end closure, and a forward end 170 to contact and open a secondary gate. It is contemplated that an opening tool may be a church key, as shown in FIG. 14, or a customized tool to accommodate various configurations of vent openings 70, including those disclosed herein. For example, in one embodiment, a modified church key is utilized that has a blunt forward end 170 to focalize the downward force on a secondary gate. As another example, the forward end 170 may be configured into a specific shape that corresponds to the shape of the vent opening 70 and associated vent form feature 82, thereby providing a direct transfer of force to the secondary gate and associated score. It is further contemplated that an opening tool may be a coin, a car key, a pen, a paper clip, a credit card, a driver's license, or other devices that are available to a consumer. In some embodiments a consumer's finger may be used without an accessory tool to open a vent opening.

Figure 15:
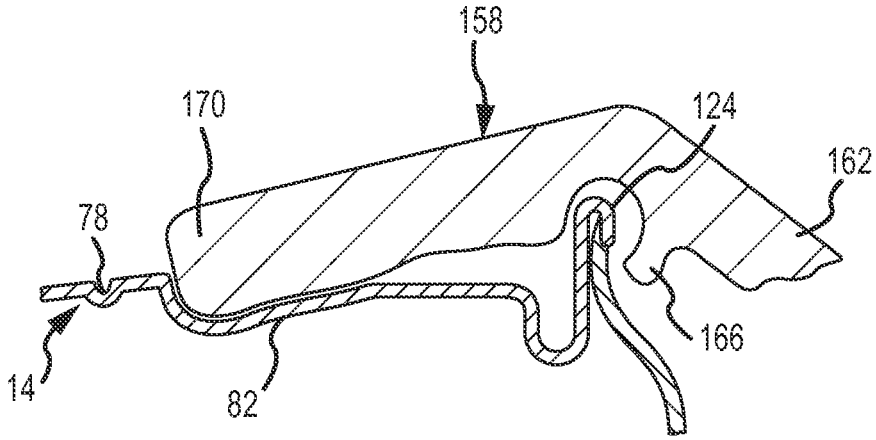
FIG. 15 is a partially fragmented section view of an opening tool selectively positioned on a container end closure according to an embodiment of the present invention.

Referring to FIG. 15, an opening tool 158 is selectively positioned on a container end closure 14 according to an embodiment of the present invention. As illustrated, a forward end 170 of the opening tool 158 is seated in a recessed vent form feature 82. To open the vent opening, a consumer engages the claw 166 with the peripheral seam 124 and lifts the handle 162. The lifting motion causes the forward end 170 of the opening tool 158 to press downward on the vent form feature 82, which in turn fractures the score 78 and opens the vent opening.

Figure 16A:
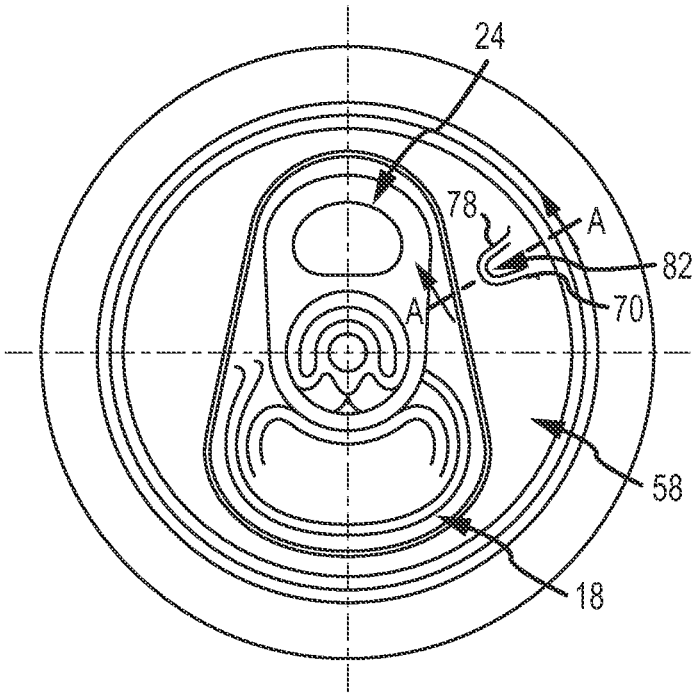
FIG. 16*a* is a top plan view of an alternative embodiment of the present invention.
Figure 16B:
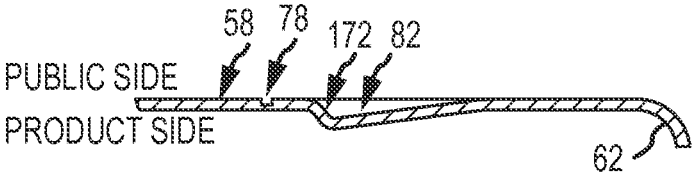
FIG. 16*b* is a cross-sectional view of the embodiment shown in FIG. 16*a* taken at line "A-A"
Figure 16C:
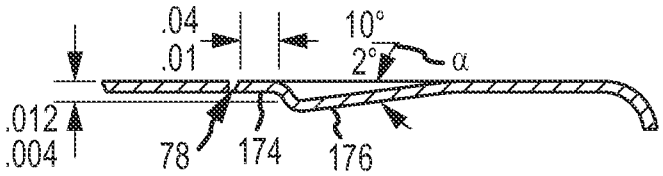
FIG. 16*c* is a cross-sectional elevation view of the embodiment shown in FIG. 16*a* taken at line "A-A", but including dimensional data and an angle ***alpha of the vent panel.

Referring now to FIGS. 16*a*-16*c*, a panel with a secondary vent feature according to one embodiment is provided. As shown in FIG. 16*a*, a vent opening 70 is provided in an upper right quadrant of an end closure. The vent opening 70 comprises a recessed vent form feature or panel 82 with a secondary score 78. FIGS. 16*b*-16*c* are cross-sectional views taken along A-A of FIG. 16*a* and depict various details of the secondary vent feature 70. As shown, a recessed portion 82 is provided with an angle $\alpha$ of between approximately 2 degrees and approximately 10 degrees with respect to a horizontal plane. Accordingly, in various embodiments, the recessed portion 82 projects downwardly toward a product side of the end closure by at least 0.004 inches and by as much as 0.03 inches. A well or trough portion is formed on the public side of the end closure, with a depth of between approximately 0.002 inches and approximately 0.015 inches. Preferably, this depth is between is approximately 0.004 inches and 0.012 inches. The well or trough of the recessed portion 82 is adapted for receiving one or more objects for tearing open the secondary vent feature 70. Such objects include, but are not limited to, fingers, keys, nails, bottle openers, church keys, etc.

As further shown in FIGS. 16*a*-16*c*, a ramp portion 172 is provided between and interconnecting the recessed portion 82 to a portion of the central panel 58 contained within the secondary score 78. The ramp feature 172 extends upwardly from the vent panel 82 and connects to a lip portion 174 of the central panel 58 bounded by secondary score 78. In various embodiments, the width of the lip portion 174 is between approximately 0.005 inches and approximately 0.05 inches. Preferably, this width is between approximately 0.01 inches and 0.04 inches.

A downwardly extending vent panel 82 comprises a length of between approximately 0.01 inches and approximately 0.25 inches in various embodiments. Preferably, the recessed vent panel 82 comprises a downwardly extending length 176 of between approximately 0.02 inches and approximately 0.23 inches. When forced downwardly with an opening tool, the vent panel 82 creates a hinge point proximate to an outer peripheral edge of the central panel 58.

The description of the present invention has been presented for purposes of illustration and description, but is not intended to be exhaustive or limiting of the invention to the form disclosed. The scope of the present invention is limited only by the scope of the following claims. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A vented metallic end closure adapted for interconnection to a neck of a container body, comprising:

a peripheral curl;

a chuck wall extending downwardly from the peripheral curl;

a countersink interconnected to a lower end of the chuck wall; and a central panel interconnected to the countersink, the central panel having a primary score defining a dispensing opening;

a secondary score defining a vent opening with a vent panel positioned proximate to the peripheral curl, wherein a secondary score termination is directed towards the peripheral curl to form a hinge point, and said vent panel is inclined downwardly toward an interior portion of said central panel to define a ramp; and a stiffening structure positioned near the secondary score.

2. The metallic end closure of claim 1, wherein the inclined panel and ramp is oriented to receive an opening tool to apply a downward force to said vent panel.

3. The metallic end closure of claim 1, wherein the vent panel is inclined at an angle of between about 2 degrees and 10 degrees.

4. The metallic end closure of claim 1, wherein the ramp has an upper end positioned in substantially a same horizontal plane as said central panel.

5. The metallic end closure of claim 1, wherein the secondary score comprises at least one of a triangular shape, an arcuate shape and a rectangular shape.

6. The metallic end closure of claim 1, wherein the secondary score comprises a bulbous shape configured to accommodate a straw.

7. The metallic end closure of claim 1, wherein the vent opening comprises a safety fold to substantially eliminate exposure of a fractured score edge to a consumer's fingers.

8. The metallic end closure of claim 1, wherein the vent opening has a surface area no greater than about 25% of the dispensing opening.

9. The metallic end closure of claim 8, wherein the vent opening is approximately 5% by area of the dispensing opening.

10. The metallic end closure of claim 1, wherein the vent opening is configured to be a secondary mode of failure relative to the dispensing opening.

11. The metallic end closure of claim 1, further comprising a pull tab interconnected to said central panel to facilitate opening of said dispensing opening.

* * * * *